US012660945B2

(12) United States Patent
Rote et al.

(10) Patent No.: US 12,660,945 B2
(45) Date of Patent: Jun. 23, 2026

(54) DIAPER CHANGING TABLE

(71) Applicants: Christopher N.J. Rote, Barcelona (ES); Skylar Rote, N. Falmouth, MA (US)

(72) Inventors: Christopher N.J. Rote, Barcelona (ES); Skylar Rote, N. Falmouth, MA (US)

( * ) Notice: Subject to any disclaimer, the term of this patent is extended or adjusted under 35 U.S.C. 154(b) by 14 days.

(21) Appl. No.: 19/181,940

(22) Filed: Apr. 17, 2025

(65) Prior Publication Data

US 2025/0380822 A1 Dec. 18, 2025

Related U.S. Application Data

(60) Provisional application No. 63/650,008, filed on May 21, 2024.

(51) Int. Cl.
*A47D 5/00* (2006.01)

(52) U.S. Cl.
CPC ..... *A47D 5/006* (2013.01); *A47D 5/003* (2013.01)

(58) Field of Classification Search
CPC ..... A47D 5/00; A47D 5/003; A47D 5/006; A47D 9/016
USPC ..... 5/655, 947; 297/255
See application file for complete search history.

(56) References Cited

U.S. PATENT DOCUMENTS 2,359,599 A * 10/1944 Allen ..... B60N 2/283 297/182
3,269,621 A * 8/1966 Dishart ..... A47D 13/08 224/159
3,462,773 A * 8/1969 Triplett ..... A47D 5/006 108/115
4,935,973 A * 6/1990 Behrman ..... A47D 5/00 5/2.1
5,310,242 A * 5/1994 Golder ..... A47D 1/10 297/14
5,615,433 A * 4/1997 Martin ..... A47D 5/006 5/655
5,785,383 A * 7/1998 Otero ..... A47D 1/02 297/378.12
6,389,624 B1 * 5/2002 Madole ..... A47D 15/008 5/655
6,421,856 B1 * 7/2002 Furnback ..... B60N 2/28 5/118
6,581,228 B1 * 6/2003 Boskovich ..... A47D 5/006 5/503.1
7,891,034 B2 * 2/2011 Smith ..... A47D 5/006 5/655
8,381,333 B2 * 2/2013 Friedman ..... A47D 9/016 5/655
10,980,355 B2 * 4/2021 Degon ..... A47D 5/003
2011/0232000 A1 * 9/2011 Rodriguez ..... B62B 9/12 5/655
2015/0282637 A1 * 10/2015 Herdman ..... A47D 5/00 5/655
2018/0146795 A1 * 5/2018 Longenecker ..... A47D 9/005

* cited by examiner

*Primary Examiner* — David R Hare

(57) ABSTRACT

The baby changing table system may comprise a base, a pad configured to be inserted into the base, a stabilizing brace having a first section and a second section, wherein the first section of the stabilizing brace rotatably interfaces with the base, and wherein the second section of the stabilizing brace interfaces with a surface.

17 Claims, 9 Drawing Sheets

DIAPER CHANGING TABLE

CROSS-REFERENCE TO RELATED APPLICATIONS

This application claims priority to, and the benefit of, U.S. Provisional Application No. 63/650,008 filed May 21, 2024 and entitled "The Change Table," which is hereby incorporated by reference in its entirety for all purposes.

TECHNICAL FIELD

This disclosure generally relates to diaper changing tables, and more particularly, to a rotatable diaper changing table with a baby wipe dispenser.

BACKGROUND

While changing tables (or changing pads) have evolved over the years, the vast majority of commercially available diaper changing stations have similar measurements. For example, such diaper changing stations or changing pads are approximately 16-19 inches (40-48 cm) wide and 28-32 inches (72-81 cm) long. The diaper changing stations are often placed on furniture such as, for example, a top surface of a chest of drawers, a dresser, a side table, or other household countertop.

However, the challenge is that such furniture items are typically 19 inches (40 cm) or less. This limited surface area may cause the diaper changing station to tip when placed on the furniture in certain orientations. As such, the diaper changing station is often positioned to maximize the amount of interface between the top surface and the bottom of the diaper changing station. The frequently used orientation places the diaper changing station sideways relative to the person changing a diaper. Such a sideways orientation is much less desirable than a frontal position. However, if the diaper changing station is placed in a frontal position, the length of the pad is often greater than the width of the countertops, so the diaper changing station hangs over the edge in a precarious manner. Such a position may put the diaper changing station in danger of tipping which may cause harm to the baby. Moreover, such a position makes it more difficult to reach the baby and change the baby's diaper. As such, a need exists for a diaper changing station that may be more optimally positioned when in use, and a diaper changing station that may be positioned against the wall when not in use.

SUMMARY

In various embodiments, the baby changing table system may comprise a base, a pad configured to be inserted into the base, a stabilizing brace having a first section and a second section, wherein the first section of the stabilizing brace rotatably interfaces with the base, and wherein the second section of the stabilizing brace interfaces with a surface.

The surface may be at least one of a wall or furniture. The first section of the stabilizing brace may rotatably interface with the base via at least one of a bolt, dowel or hinge. The base may include an aperture for receiving a fastener on the stabilizing brace. A head end of the base may include an aperture for receiving a fastener on the stabilizing brace. The base may include a threaded aperture for receiving a threaded fastener on the stabilizing brace. The base may include an aperture for receiving a bolt on the stabilizing brace, and wherein a washer and nut interface with the bolt.

The first section of the stabilizing brace may rotatably interface with the base at a head of the base. A head of the base may be semi-circular in shape. The base may rotate between about −90 degrees and about 90 degrees with respect to a wall that interfaces with the stabilizing brace. The first section of the stabilizing brace may be perpendicular to the second section of the stabilizing brace. The first section of the stabilizing brace may be horizontal to the floor and the second section of the stabilizing brace may be perpendicular to the floor. The second section of the stabilizing brace may include a cross bar.

The base may include one or more compartments. The base may include one or more cylindrical compartments. The base may include one or more compartments, wherein the one or more compartments contain at least one of wet wipes, baby wipes, surface cleaning wipes, tissues, sponges, towels, paper towels, powder, disinfectant, lotion, or medicine.

BRIEF DESCRIPTION OF THE DRAWINGS

The accompanying drawings, wherein like numerals depict like elements, illustrate exemplary embodiments of the present disclosure, and together with the description, serve to explain the principles of the disclosure. In the drawings.

DETAILED DESCRIPTION

Figure 1:
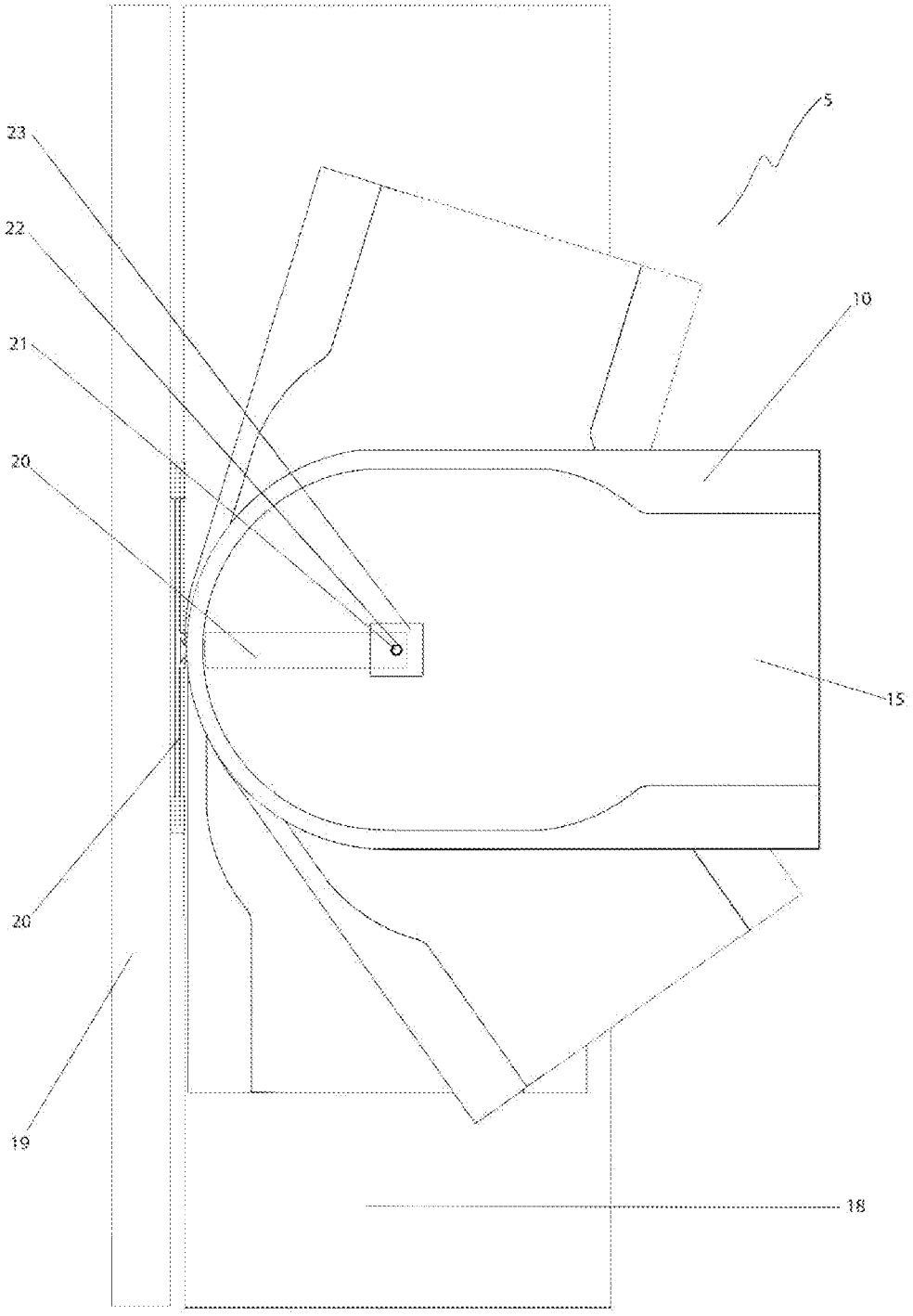
FIG. 1 is an exemplary drawing showing the rotation of the base 10 and pad 15 on stabilizing brace 20, resting on furniture 18, adjacent to wall 19, with bolt 21, nut 22 and washer 23, in accordance with various embodiments.

The disclosed improved changing table system 5 is configured to adjust and/or swivel. The system 5 includes any object that may adjust relative to another object. While the phrase changing table system 5 may be used herein, the disclosure contemplates the use of any table, container or tray. For example, the system 5 may be applicable to a serving tray, a storage bin, a tool box, a surgical tray, a pet washing tub and/or the like. In various embodiments, and as set forth in FIG. 1, the changing table system 5 may include a base 10, a pad 15 and a stabilizing brace 20. In various embodiments, any of the components (e.g., base 10, pad 15 and/or stabilizing brace 20) discussed herein may be used interchangeably with the other components. The base 10 and/or pad 15 may include different contours which are ergonomically designed to provide optimal positioning and safe support for the baby. The system 5 may be installed on most surfaces (e.g., table or chest), so the system 5 greatly enhances the number and types of places to use a changing table. The system 5 may be securely installed on surfaces that are narrower than the full length of the changing table. The system 5 allows the baby to be positioned in many different ways, in relation to the person changing the baby. For example, the baby can be facing sideways to the left or to the right, the baby can be facing forward, and every angle in between. The various angles may aid in the changing process, allow different viewing angles and allow the person changing the baby to provide consistent eye contact with the baby.

The base 10 may be any size, shape, height or depth. The base 10 may comprise any material such as, for example, plastic. The base 10 may include a curved head end (first end). The curved head end may be configured as a semi-circle. The curved head end is configured to allow the foot end (second end) to swivel, as explained in more detail below.

Figure 2:
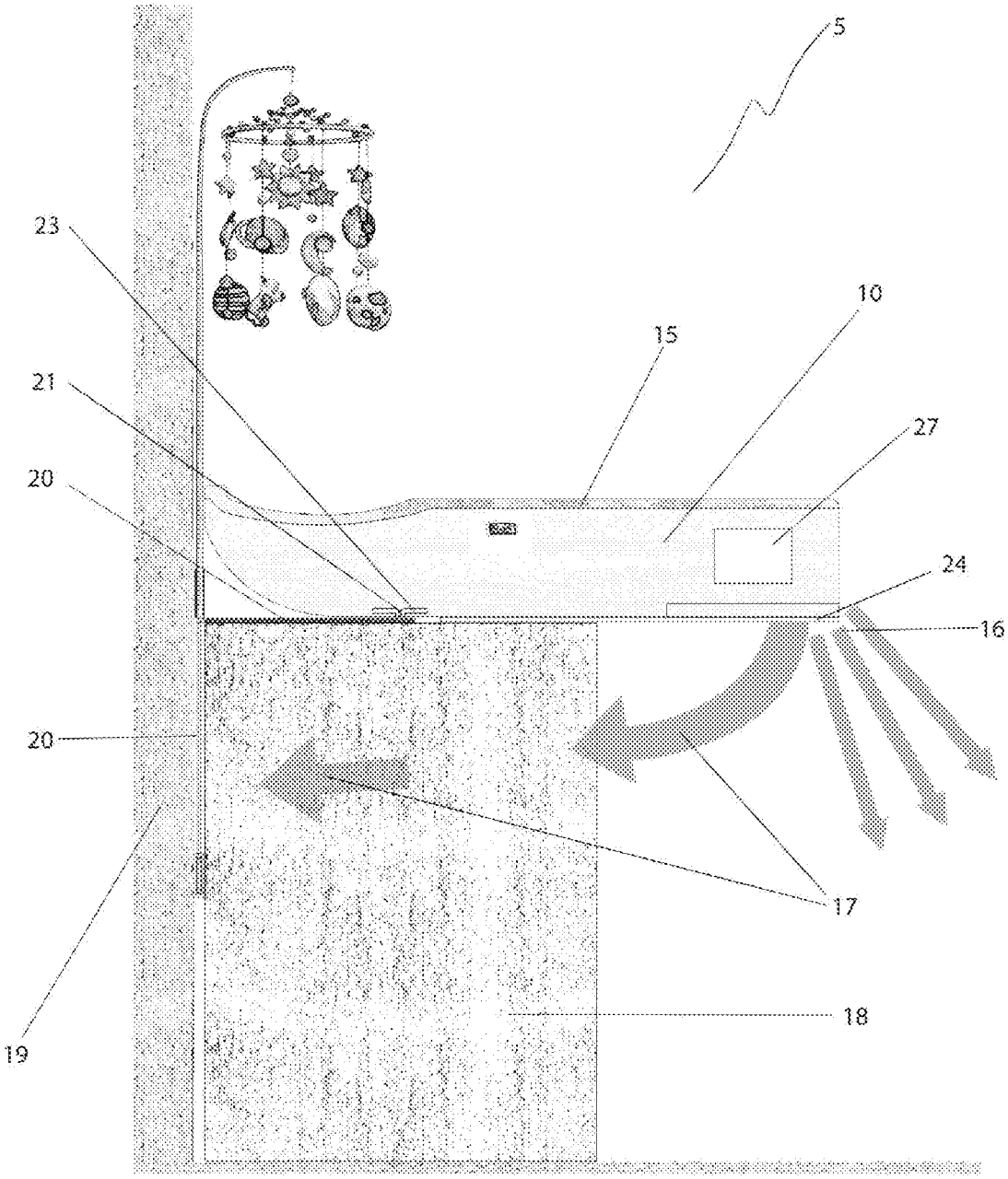
FIG. 2 is an exemplary drawing showing, the base 10 and pad 15 assembled and situated on Furniture 18, positioned against wall 19, the stabilizing brace 20, bolt 21, washer 23, one of the glides 24, part of the shaped space 27 created between the base 10 and pad 15, arrows 16 indicating the direction of tipping prevented by System 5, arrows 17 indicating the directional force placed on the furniture 18 causing its distance to the wall 19 to be maintained, and a mobile attached to the stabilizing brace 20 in accordance with various embodiments.
Figure 3:
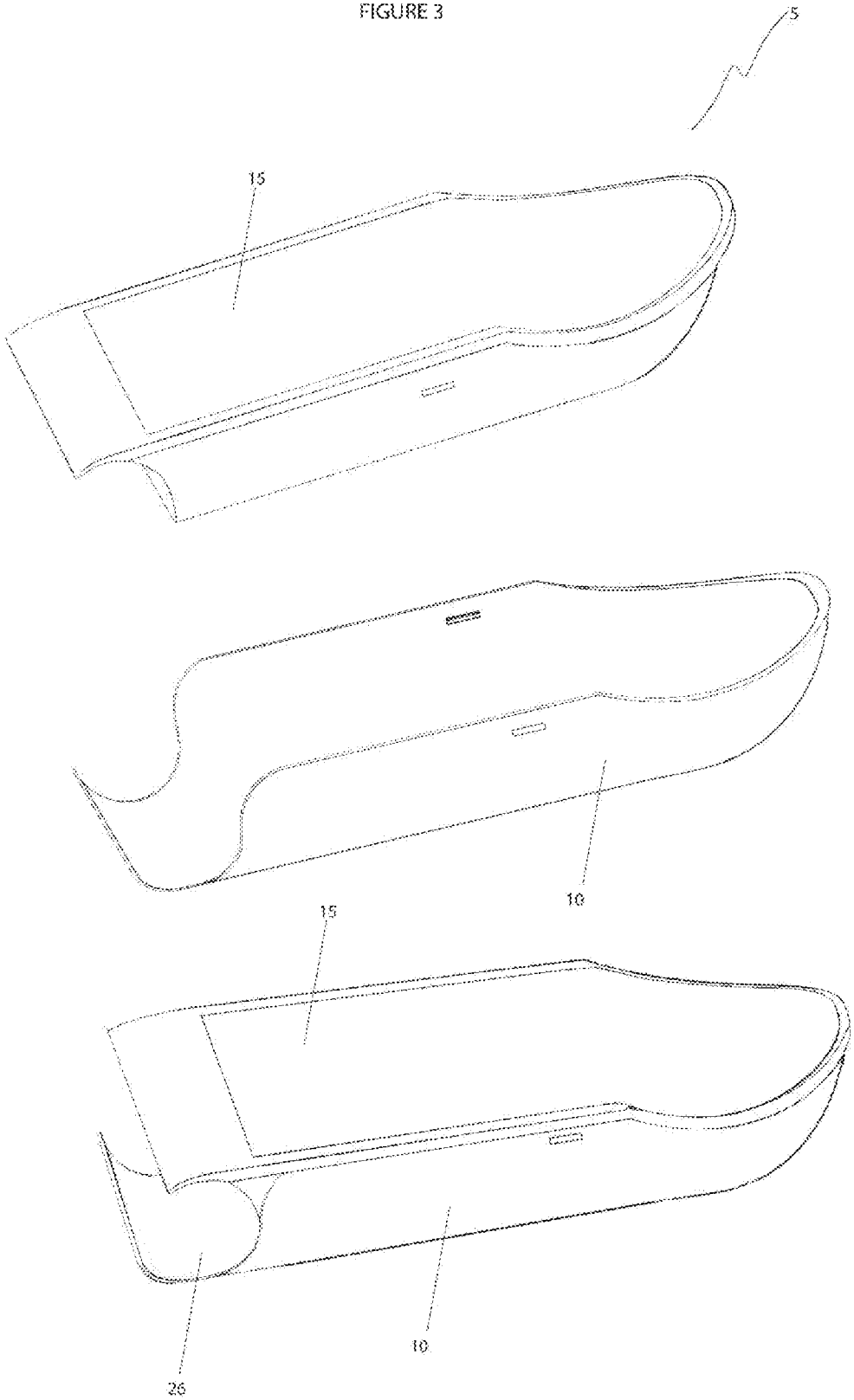
FIG. 3 is an exemplary drawing showing the pad 15 separately, the base 10 separately and the base 10 and pad 15 assembled, forming the shaped space created between them 26, in accordance with various embodiments.
Figure 4:
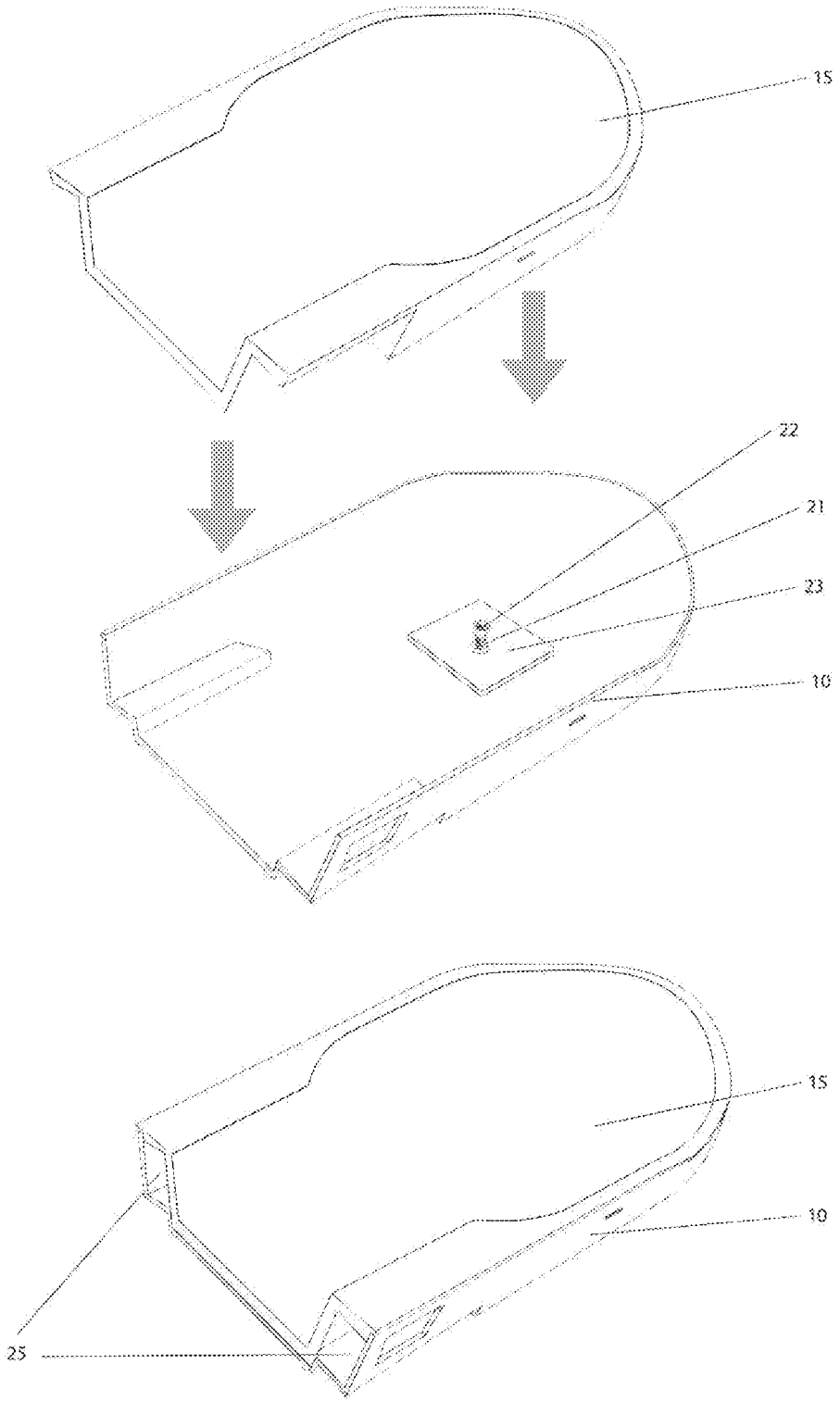
FIG. 4 is an exemplary drawing showing the pad 15 separately, base 10 separately, bolt 21, nut 22, washer 23, and base 10 and pad 15 assembled creating the shaped space between them 25 in accordance with various embodiments.

The base 10 may include one or more compartments 25 for supplies, as shown in FIGS. 2, 3 and 4. The compartment 25 may be any size, shape, height or depth. The compartment 25 may be open to provide open access. The compartment 25 may include a door over at least a portion of, or all of, the opening to the compartment 25. The door may include one or more hinges. The door may include a lock. The door may include a small opening to access, for example, one wipe at a time. The door may be spring-loaded, such that the door may pop open, in response to pushing on the door. The door may include a handle on the door. The handle may also serve as a handle for rotating the base 10. The supplies that may be stored in the compartment 25 include, for example, wet wipes, baby wipes, surface cleaning wipes, tissues, sponges, towels, paper towels, powder, disinfectant, lotion, medicine and/or the like. The compartment 25 may include packs (e.g., plastic packs) that contain the wipes. The packs may be secured in the compartment 25 with tape, Velcro or other adhesive. The system 5 may include the compartments 25 in any location. The wipes may be available on the left side and/or the right side, depending on the person's preference. In various embodiments, the system 5 may contain one or more compartments 25 positioned in a curved space formed in between the base 10 and the pad 15, such that the compartments 25 may hold baby wipes packaged in cylindrical canisters, as shown in FIG. 3. Locating the wipes in the one or more compartments 25 has advantages of, for example, easy access, dispensing with a single hand (no need to hold on to the package while removing a wipe), convenient storage and/or the elimination of countertop clutter.

In various embodiments, the base 10 may include one or more glides. The glides may comprise a protruding rim on the bottom of the base 10. The glides may facilitate smooth swiveling of the base 10 on the top of the furniture. The glides may prevent the base 10 from catching on the edges of the base 10, as the base 10 is rotated. The glides may minimize any potential abrasive scratching on the furniture or on the surface of the base 10. The base 10 may include a safety belt.

The pad 15 may be any size, shape, height or depth. The pad 15 may be hypoallergenic. The pad 15 may comprise any material such as, for example, foam. The pad 15 may be a similar configuration as the base 10, but slightly smaller dimensions such that the pad 15 may be inserted into and/or over the base 10. When the pad 15 is inserted into the base 10, some engineered space may exist between the pad 15 and the base 10. Such extra space may house a compartment 25 for wipes or other items, as discussed in more detail herein. In various embodiments, base 10 and pad 15 may be integrated. The pad 15 may consist of one or more pads 15. For example, smaller pads 15 may be inserted into the base 10 in sections. The pad 15 may include multiple pads 15 joined together. The pad 15 may include a curved head end (first end). The curved head end may be configured as a semi-circle. The pad 15 may be ergonomically contoured. Such a design facilitates the changing process and allows any liquids to drain towards the foot end of the pad 15 for easy cleaning. At least a portion of pad 15 may include an upper padded lip that covers at least a portion of the top rim of the base 10. Such a padded lip may provide soft protection for the baby, while the baby is lowered into the pad 15.

Figure 7:
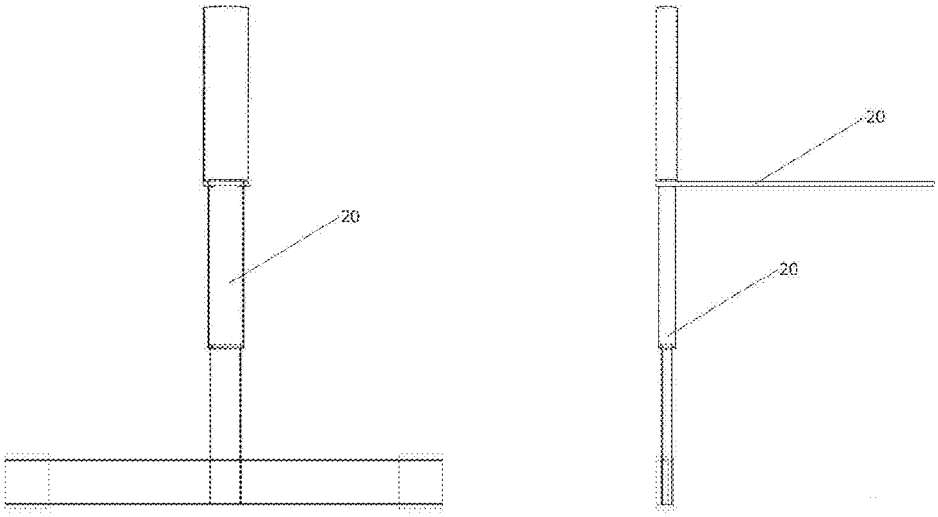
FIG. 7 is an exemplary drawing showing a telescoping stabilizing brace 20, in accordance with various embodiments.

The stabilizing brace 20 may be any size, shape or combination of components. The size, shape or combination of components of the stabilizing brace may be customized based on the size of the base 10. The stabilizing brace 20 may comprise any material such as, for example, metal. The stabilizing brace 20 may include any suitable tensile strength, such that the stabilizing brace 20 may endure the stresses exerted upon the stabilizing brace 20 during use of the system 5. The stabilizing brace 20 stays secured to a surface (e.g., mount, wall and/or furniture) and it is rotationally secured to the base 10, such that the base 10 may be rotated while the stabilizing brace 20 stays secured. The stabilizing brace 20 provides stability for the base 10 and prevents the base 10 from tipping (e.g., while extended over the edge of the furniture). The stabilizing brace 20 may include components and configurations that provide reduced weight, case of use, elimination or minimization of consumer assembly and/or the ability to be packaged without adding significant volume to the package of components during shipping. Any of the components of the stabilizing brace 20 may be telescoping components, as shown in FIG. 7, such that the length of the components may be adjustable and selected by the installer. The optimum length of the telescoping components may be based on the materials and sturdiness of the furniture, wall, etc.

The stabilizing brace 20 may interface with any point on the changing table system 5. In various embodiments, a first section of the stabilizing brace 20 may interface with the base 10. The stabilizing brace 20 may interface with the base 10 near the center of the semi-circle on the curved head end. A second section of the stabilizing brace 20 may interface with the wall and/or a piece of furniture (e.g., the furniture that supports the base 10). The first section and second section of the stabilizing brace 20 may be integrated. While the base 10 is not in use, the stabilizing brace 20 may enable the longer side of the base 10 to be situated adjacent to, parallel with and/or abutting a wall. As partially shown in FIG. 1, the stabilizing brace 20 may allow the base 10 to swivel up to about 180 degrees. The base may swivel about −90 degrees to about 90 degrees. When swiveling the base 10, the head end remains in its relative position next to the wall.

The system 5 may include a protective bumper between the furniture and the wall to protect the stabilizing brace 20 from damaging the wall. The bumper may be any size or shape. The bumper may be comprised of rubber, neoprene or any other cushioning like material. The bumper may be configured to go over any portion of the stabilizing brace 20. For example, the bumper may go over the ends of the stabilizing brace 20 which may be sharp. The bumper may prevent marring or scratching of the wall and/or the supporting furniture. The bumper may fill the space behind the furniture that is often caused by a baseboard (at the junction of the wall and floor) that does not allow the furniture to fully abut the wall. The bumpers may be replaceable. The bumpers may vary in size and shape.

More particularly with respect to the stabilizing brace, in various embodiments, the stabilizing brace 20 may include a first segment and/or a second segment. The first segment may include a horizontal segment that is substantially parallel to the floor and/or top of the furniture surface. The horizontal segment may include an attachment device that interfaces with the base 10. For example, the horizontal segment may include a threaded bolt that interfaces with reverse threads in an aperture on the bottom of the base 10. The horizontal segment may include a threaded bolt that goes through the aperture on the bottom of the base 10 and a nut is secured to the bolt on the inside of the base 10.

Figure 5:
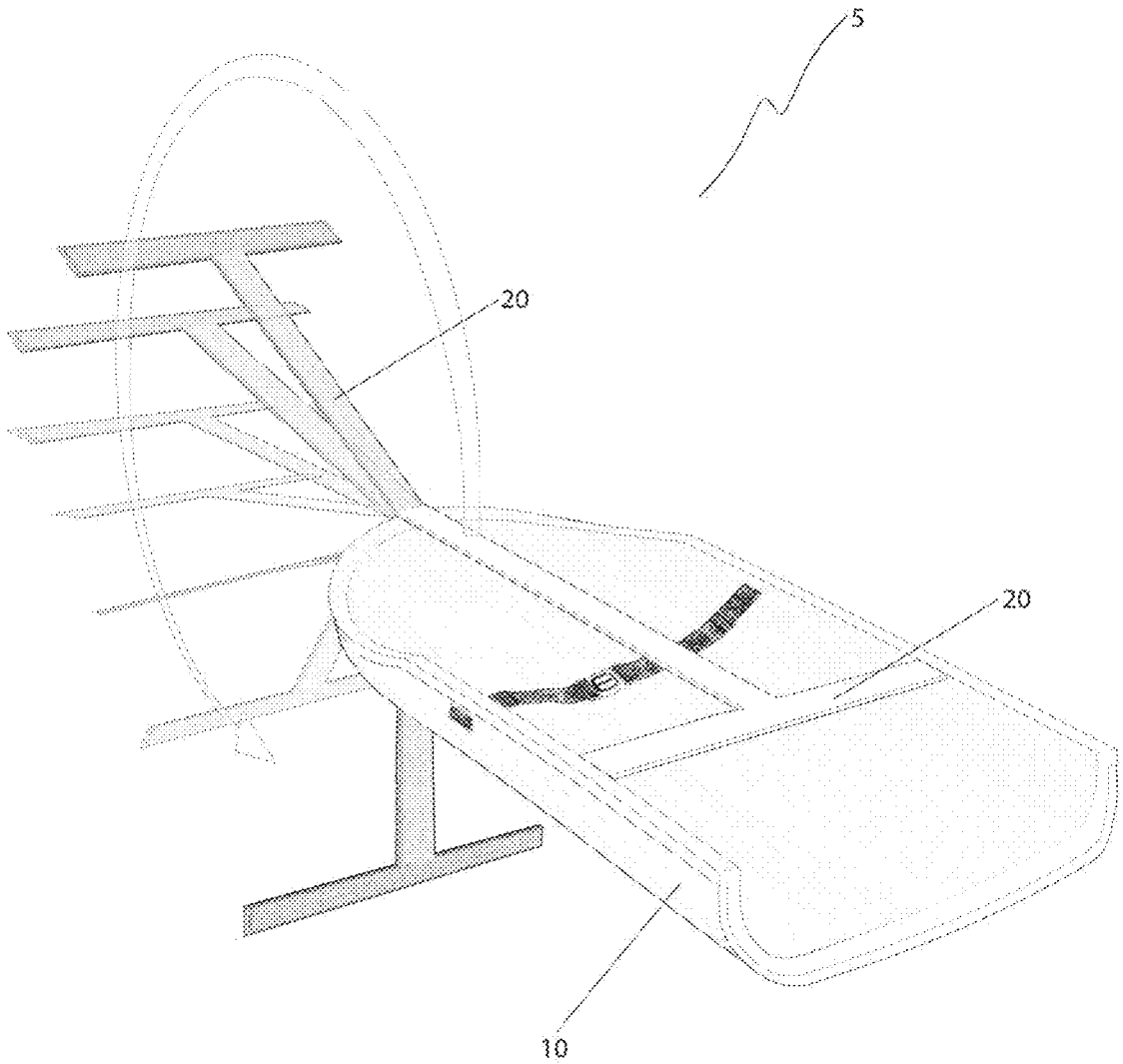
FIG. 5 is an exemplary drawing showing the unfolding of the stabilizing brace 20 from the base 10 and pad 15, in accordance with various embodiments.
Figure 8:
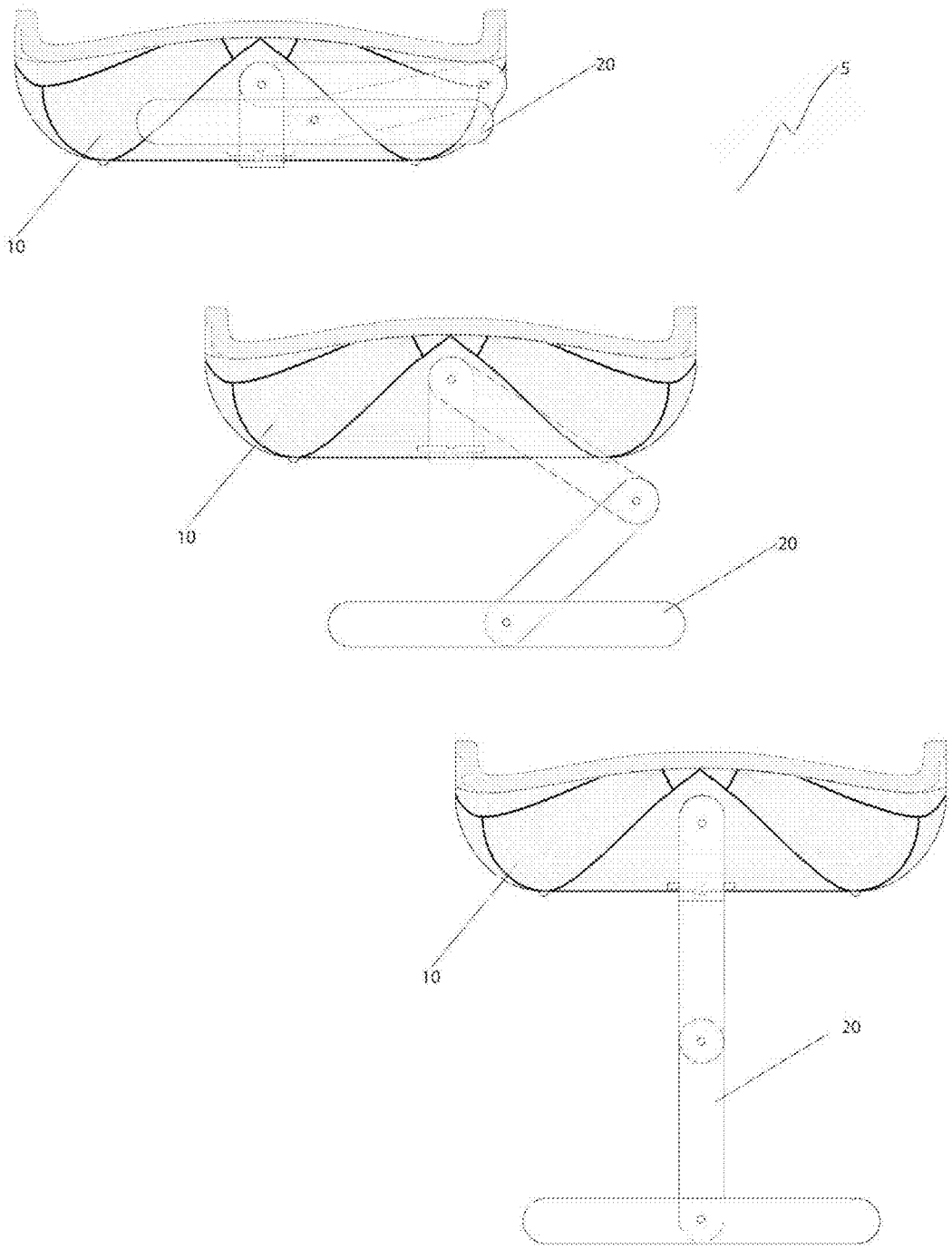
FIG. 8 is an exemplary drawing showing the unfolding of a five-part stabilizing brace 20 from the base 10, in accordance with various embodiments.

The second segment may include a descending segment or vertical segment that is substantially perpendicular to the floor and/or substantially perpendicular to the top of the furniture surface. The vertical segment may be substantially parallel to the wall and/or substantially parallel to the side of the furniture. Each of the segments may include one or more components that comprise each segment. The vertical segment and horizontal segment may be integrated together. The vertical segment and horizontal segment may be received into one another to form a L configuration. The vertical segment and horizontal segment may connect to each other using any fastener, hinge, interlock, insert or other connector. The vertical segment and/or horizontal segment may be folded up (e.g., in the packaging), then configured to be unfolded in certain sections (e.g., for installation), as shown in FIGS. 5 and 8. For example, the vertical segment and/or horizontal segment may comprise one or more components each. Each of the components may be connected with a hinge or rotational fastener, such that the components may partially or fully fold with respect to each other.

Figure 6:
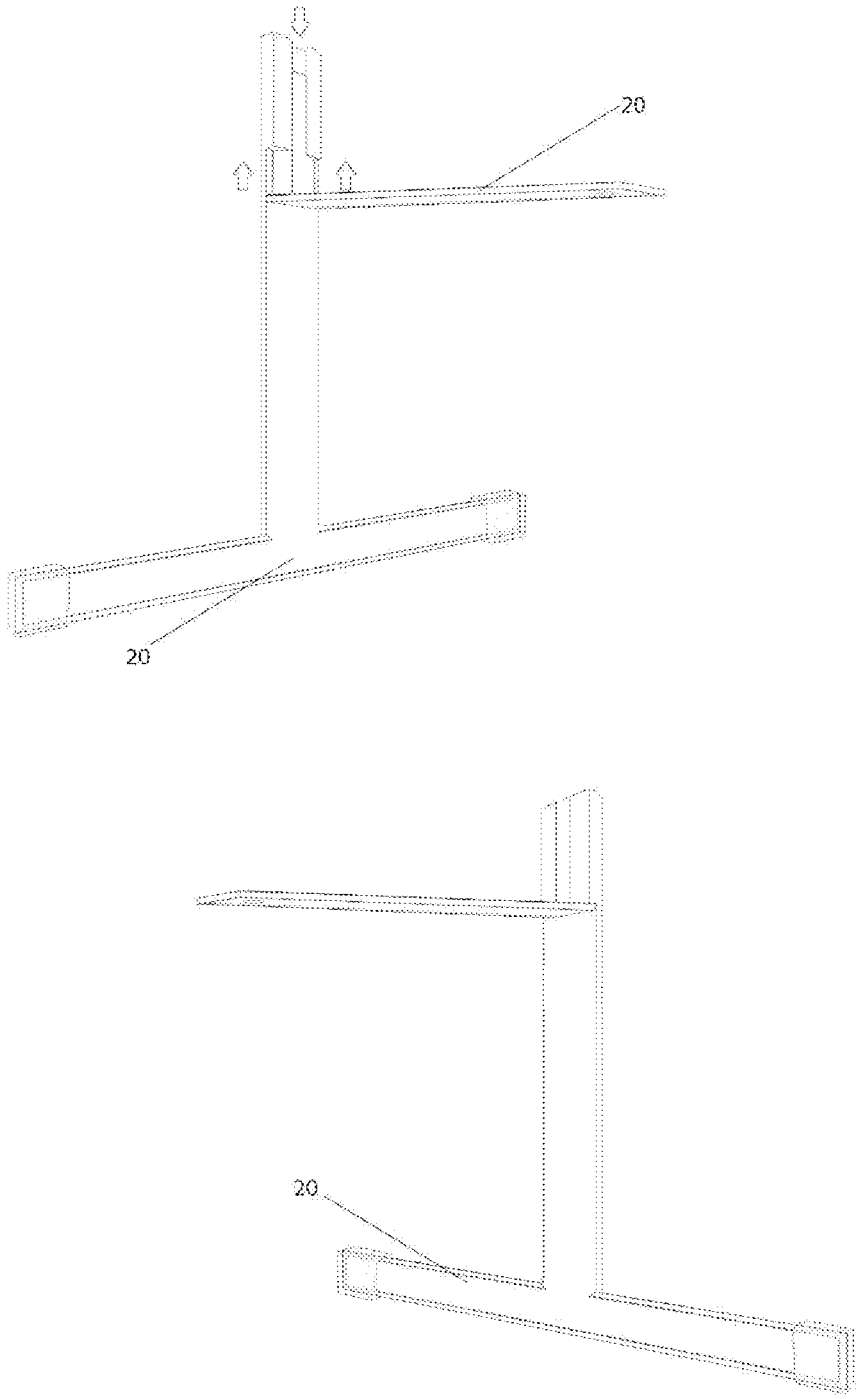
FIG. 6 is an exemplary drawing showing a two-part stabilizing brace 20, and particularly indicating its lower portion forming a "T" shape or "crossbar" in accordance with various embodiments.
Figure 9:
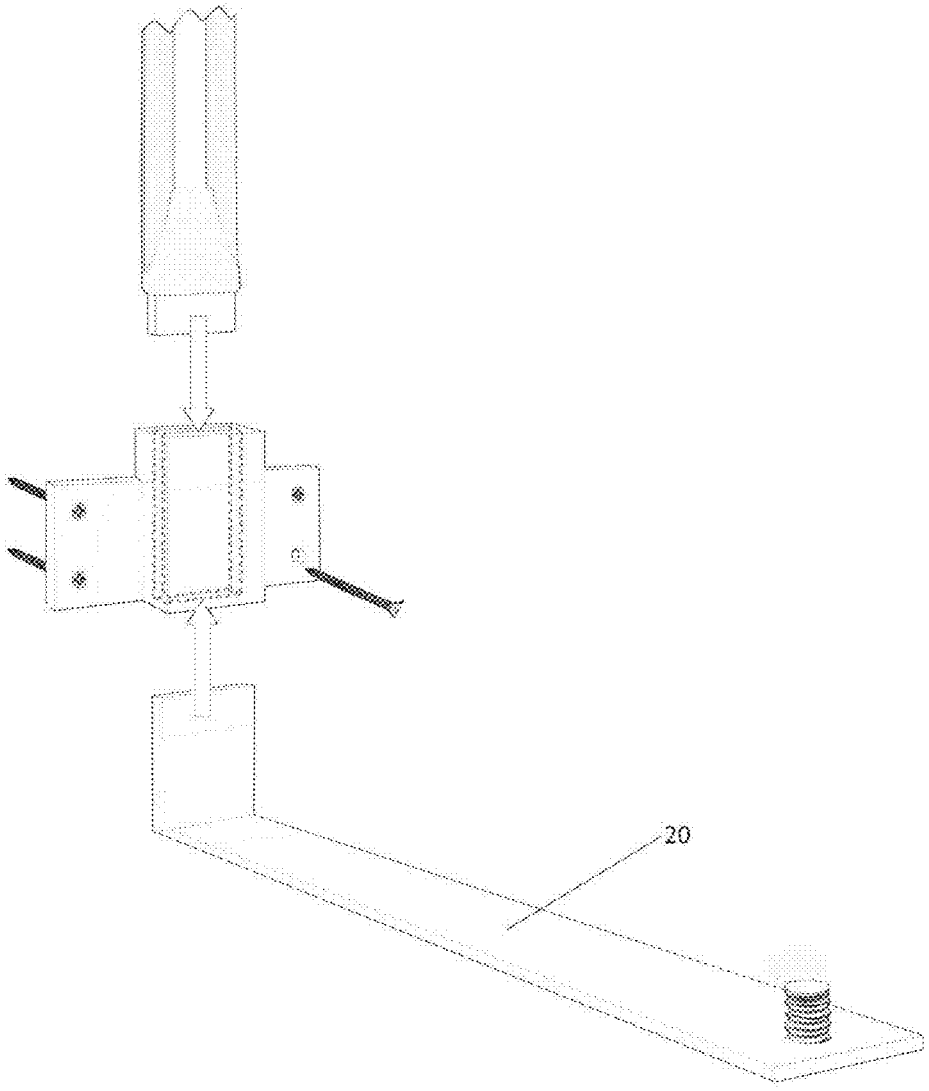
FIG. 9 is an exemplary drawing showing a wall-mounted stabilizing brace 20 that is configured to interface with the base 10, in accordance with various embodiments.

In various embodiments, the full vertical segment may not be needed. For example, the horizontal segment may connect directly to a wall, to furniture or to another surface. The system 5 may include a wall plate (wall mounted security brace). The wall plate may connect to the wall, furniture or other surface. The horizontal segment may interface with the wall plate. For example, the horizontal segment may insert into a slot in the wall plate. The horizontal segment may include an angled end that inserts vertically into a slot in the wall plate, as shown in FIG. 9. A fastener may be used to connect the wall plate to the horizontal segment. The horizontal segment may include an angled end that inserts vertically into a slot in a vertical segment that is mounted to furniture or the wall, as shown in FIG. 6.

The horizontal segment may be removably or permanently affixed to the base 10. For example, the horizontal segment may be removably or permanently affixed to an aperture in the underside of the base 10. The end of the bolt and the nut may interface between the base 10 and the pad 15. The attachment device may include a bolt, locking nut and/or washer (e.g., round, square or hexagonal). The size and strength of the attachment device may be suitable to disperse the forces over the base 10, in response to use of the system 5. The size and strength of the attachment device may be suitable to prevent undesired twisting of the base 10 during the rotation process. The vertical segment may be positioned in the space between the furniture and the adjacent wall.

The vertical segment may include a horizontal cross bar that interfaces with the vertical segment and provides extra support for the vertical segment. The cross bar may be positioned at any point on the vertical segment. For example, the cross bar may be positioned at the end of the vertical segment (the end furthest from the horizontal segment), such that the cross bar and vertical segment form a "T" configuration.

The base 10, pad 15 and/or stabilizing brace 20 may include an opening or attachment to allow for a baby toy to be connected to the baby changing system 5. For example, the components may hold a mobile in place, so that the mobile may dangle over the baby's head to attract attention, provide fascination and provide a distraction. When attached to the stabilizing brace 20 (e.g., vertical segment), as shown in FIG. 2, the mobile remains out of the changer's way and over the baby's head, even during rotation of the base 10.

In various embodiments, the changing table system 5 may include any other device or configuration to help provide stability and minimize tipping of the base 10. For example, the system 5 may include one or more suction cup devices to secure the base 10 to a surface. The system 5 may include one or more reservoirs that are temporarily or permanently filled with a material to help weigh down the base 10. The reservoir may contain a liquid, sand or another heavy material. The reservoir may include an inlet and/or outlet to fill and/or empty the reservoir. The inlet/outlet may include a cover or plug.

The detailed description of various embodiments herein makes reference to the accompanying drawings and pictures, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not for purposes of limitation.

For simplicity and clarity of illustration, the drawing figures illustrate the general manner of construction, and descriptions and details of some features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system 5, article, device, or apparatus that comprises a list of elements is not necessarily limited to those elements, but may include other elements not expressly listed or inherent to such process, method, system 5, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

As defined herein, "approximately" or "about" can, in some embodiments, mean within plus or minus ten percent of the stated value. In other embodiments, "approximately" or "about" can mean within plus or minus five percent of the stated value. In further embodiments, "approximately" or "about" can mean within plus or minus three percent of the stated value. In yet other embodiments, "approximately" or "about" can mean within plus or minus one percent of the stated value.

Although system and methods have been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that any element of the figures may be modified, and that the foregoing discussion of certain of these embodiments does not necessarily represent a complete description of all possible embodiments. For example, one or more of the procedures, processes, or activities may include different procedures, processes, and/or activities and be performed by many different modules, in many different orders.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The steps recited in any of the method or process descriptions may be executed in any order and are not limited to the order presented. Moreover, any of the functions or steps may be outsourced to or performed by one or more third parties. Modifications, additions, or omissions may be made to the system, apparatuses, and methods described herein without departing from the scope of the disclosure. For example, the components of the system and apparatuses may be integrated or separated. An individual component may be comprised of two or more smaller components that may provide a similar functionality as the individual component. Moreover, the operations of the system and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. Furthermore, any reference to singular includes plural embodiments, and any reference to more than one component may include a singular embodiment. Use of 'a' or 'an' before a noun naming an object shall indicate that the phrase be construed to mean 'one or more' unless the context sufficiently indicates otherwise, as set forth in Slip op. at 8-9 (Fed. Cir. Oct. 19, 2023) (citing Baldwin Graphic Sys., Inc. v. Siebert, Inc., 512 F.3d 1338, 1342-43 (Fad. Cir. 2008)).

System, methods, and products are provided. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Numbers, percentages, or other values stated herein are intended to include that value, and also other values that are about or approximately equal to the stated value, as would be appreciated by one of ordinary skill in the art encompassed by various embodiments of the present disclosure. A stated value should therefore be interpreted broadly enough to encompass values that are at least close enough to the stated value to perform a desired function or achieve a desired result. The stated values include at least the variation to be expected in a suitable industrial process and may include values that are within 5% of a stated value. Additionally, the terms "substantially," "about" or "approximately" as used herein represent an amount close to the stated amount that still performs a desired function or achieves a desired result. For example, the term "substantially," "about" or "approximately" may refer to an amount that is within 5% of a stated amount or value. Further, all ranges may include upper and lower values and all ranges and ratio limits disclosed herein may be combined.

As defined herein, two or more elements are "integral" if they are comprised of the same piece of material. As defined herein, two or more elements are "non-integral" if each is comprised of a different piece of material.

As used herein, "satisfy," "meet," "match," "associated with", or similar phrases may include an identical match, a partial match, meeting certain criteria, matching a subset of data, a correlation, satisfying certain criteria, a correspondence, an association, an algorithmic relationship, and/or the like. Similarly, as used herein, "authenticate" or similar terms may include an exact authentication, a partial authentication, authenticating a subset of data, a correspondence, satisfying certain criteria, an association, an algorithmic relationship, and/or the like.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Moreover, it is not necessary for a device or method to address each and every problem sought to be solved by the present disclosure for it to be encompassed by the present claims. Furthermore, no element, component, or method step in the present disclosure is intended to be dedicated to the public regardless of whether the element, component, or method step is explicitly recited in the claims. No claim element is intended to invoke 35 U.S.C. § 112 (f) unless the element is expressly recited using the phrase "means for" or "step for". As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Although the invention has been shown and described with respect to several preferred embodiments, certain equivalent alterations and modifications may occur to others skilled in the art upon the reading and understanding of these specifications and the concepts illustrated in the annexed drawings. In particular with regard to the various functions performed by the above described components (assemblies, devices, etc.) and the terms used to describe such components and their functions, these are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention.

In addition, while a particular feature of the invention may have been disclosed with respect to only one of the several embodiments, such feature may be combined with one or more features of the other embodiments as may be desired and advantageous for any given or particular application, and any embodiments later deemed unnecessary or undesirable may be excluded without consequence to the validity of the other claims. This applies to all the claims and specifically to the system 5 and various designs of the system 5 and its function holding in place any one upper surface, while resting on any other lower surface and simultaneously allowing for rotation.

The invention claimed is:

1. A baby changing table system comprising:

a base configured to rest on a horizontal surface, the base positioned adjacent to a wall or substantially vertical surface, the wall or substantially vertical surface oriented perpendicular to the horizontal surface;

a pad configured to be inserted into the base, wherein when the pad is assembled with the base, a shaped space, is formed in between the base and the pad;

a stabilizing brace having a first section and a second section, the first and second sections connected to one another with a hinge, rotational fastener, or interlocking coupler wherein the first section of the stabilizing brace rotatably interfaces with the base, and wherein the second section of the stabilizing brace interfaces with the wall or substantially vertical surface, and wherein the first and second section of the stabilizing brace engage together to prevent tipping or tilting of the base and pad when positioned extending beyond an edge of the horizontal surface.

2. The system of claim 1, wherein the horizontal surface comprises a dresser, a chest of drawers or a table.

3. The system of claim 1, wherein the first section of the stabilizing brace rotatably interfaces with the base via at least one of a bolt, dowel or hinge.

4. The system of claim 1, wherein the base includes an aperture for receiving a fastener on the first section of the stabilizing brace.

5. The system of claim 1, wherein a head end of the base includes an aperture for receiving a fastener on the stabilizing brace.

6. The system of claim 1, wherein the base includes a threaded aperture for receiving a threaded fastener on the first section of the stabilizing brace.

7. The system of claim 1, wherein the base includes an aperture for receiving a bolt on the stabilizing brace, and wherein a washer and a nut interface with the bolt.

8. The system of claim 1, wherein the first section of the stabilizing brace rotatably interfaces with the base at a head of the base.

9. The system of claim 1, wherein a head end of the base and pad are both semi-circular in shape and are configured to allow for rotation while secured by the stabilizing brace and remain equidistant to the wall or the substantially vertical surface.

10. The system of claim 1, wherein the base rotates between negative 90 degrees and positive 90 degrees with respect to a wall or the substantially vertical surface that interfaces with the stabilizing brace.

11. The system of claim 1, wherein the first section of the stabilizing brace is perpendicular to the second section of the stabilizing brace.

12. The system of claim 1, wherein the first section of the stabilizing brace is horizontal to a floor and the second section of the stabilizing brace is perpendicular to the floor and wherein the stabilizing brace is configured to prevent the base and pad from tipping or tilting when extended over an edge of the dresser, chest of drawers, table or horizontal surface.

13. The system of claim 1, wherein the base includes one or more cylindrical or rectangular compartments.

14. The system of claim 1, wherein the shaped space created between the pad and the base defines one or more compartments, and wherein the one or more compartments contain at least one of wet wipes, baby wipes, surface cleaning wipes, tissues, sponges, towels, paper towels, powder, disinfectant, lotion, or medicine.

15. The system of claim 1, wherein the second section of the stabilizing brace includes a cross bar shaped to resemble an upside down "T" configured to provide greater stability.

16. The system of claim 1, wherein the base includes one or more safety belts.

17. The system of claim 1, wherein the base includes one or more glides configured to minimize abrasion to a supporting surface during rotation.

* * * * *